US008387494B2

(12) United States Patent
Murata et al.

(10) Patent No.: US 8,387,494 B2
(45) Date of Patent: Mar. 5, 2013

(54) PUNCHING METHOD USING PUNCH AND PUNCH FOR PUNCHING

(75) Inventors: Shinichi Murata, Aichi (JP); Tetsufumi Yoshida, Kyoto (JP)

(73) Assignees: Musashi Seimitsu Industry Co., Ltd., Aichi (JP); Nichidai Corporation, Kyoto (JP)

( * ) Notice: Subject to any disclaimer, the term of this patent is extended or adjusted under 35 U.S.C. 154(b) by 516 days.

(21) Appl. No.: 12/381,312

(22) Filed: Mar. 10, 2009

(65) Prior Publication Data

US 2009/0229432 A1 Sep. 17, 2009

(30) Foreign Application Priority Data

Mar. 14, 2008 (JP) ..... 2008-065891

(51) Int. Cl.

| | |
|---|---|
| ***B26D 1/00*** | (2006.01) |
| ***B26D 3/00*** | (2006.01) |
| ***B26D 7/06*** | (2006.01) |
| ***B26F 1/14*** | (2006.01) |
| ***B21D 43/28*** | (2006.01) |
| ***B21D 53/28*** | (2006.01) |
| ***B21K 27/06*** | (2006.01) |
| ***B21K 1/30*** | (2006.01) |

(52) U.S. Cl. ..... 83/13; 83/25; 83/686; 72/324; 29/893

(58) Field of Classification Search ..... 83/686, 83/13, 25, 51, 54, 178; 72/324–326, 333, 72/337–338, 352, 353.2, 354.6, 355.2, 358–359; 29/893, 893.34

See application file for complete search history.

(56) References Cited

U.S. PATENT DOCUMENTS

| | | | | |
|---|---|---|---|---|
| 2,756,825 | A * | 7/1956 | Janiszewski | 384/30 |
| 3,602,078 | A * | 8/1971 | Schindler | 83/32 |
| 4,170,890 | A * | 10/1979 | Kojima | 72/359 |
| 4,248,111 | A * | 2/1981 | Wilson et al. | 83/140 |
| 4,956,989 | A * | 9/1990 | Nakajima | 72/327 |
| 5,044,244 | A * | 9/1991 | Olson | 83/686 |
| 5,235,881 | A * | 8/1993 | Sano et al. | 83/55 |
| 5,718,774 | A * | 2/1998 | Tukamoto et al. | 148/219 |
| 6,178,801 | B1 * | 1/2001 | Ishida | 72/354.2 |

(Continued)

FOREIGN PATENT DOCUMENTS

| | | |
|---|---|---|
| JP | 5-185177 A | 7/1993 |
| JP | 11-010273 A | 1/1999 |
| JP | 2006-159218 A | 6/2006 |
| JP | 2006-305599 A | 11/2006 |

*Primary Examiner* — Ghassem Alie
*Assistant Examiner* — Bharat C Patel
(74) *Attorney, Agent, or Firm* — Carrier Blackman & Associates, P.C.; William D. Blackman; Joseph P. Carrier

(57) ABSTRACT

An object of the present invention is to provide a punching method using a punch, which makes it possible to effectively improve the durability of a tooth portion of the punch. In a punching method using a punch for forming a through-hole in a workpiece by punching the workpiece using a punch, at least a tooth portion of the punch is made substantially solid when the workpiece is punched by the punch, and the tooth portion is made substantially hollow, thereby a diameter of the tooth portion is reduced by a reaction force received from the workpiece, when the workpiece is separated from the punch after the punching of the workpiece.

4 Claims, 6 Drawing Sheets

WORKPIECE PUNCHING STEP

U.S. PATENT DOCUMENTS 6,332,347 B1 * 12/2001 Gomi ..... 72/355.6
6,591,648 B1 * 7/2003 Ash et al. ..... 72/55
7,249,480 B2 * 7/2007 Ghiran et al. ..... 72/55
7,360,384 B1 * 4/2008 Ghiran et al. ..... 72/55
7,420,109 B2 * 9/2008 Wasser et al. ..... 84/385 R
2006/0060046 A1 * 3/2006 Sugizaki et al. ..... 83/138

* cited by examiner

FIG.2 WORKPIECE SETTING STEP
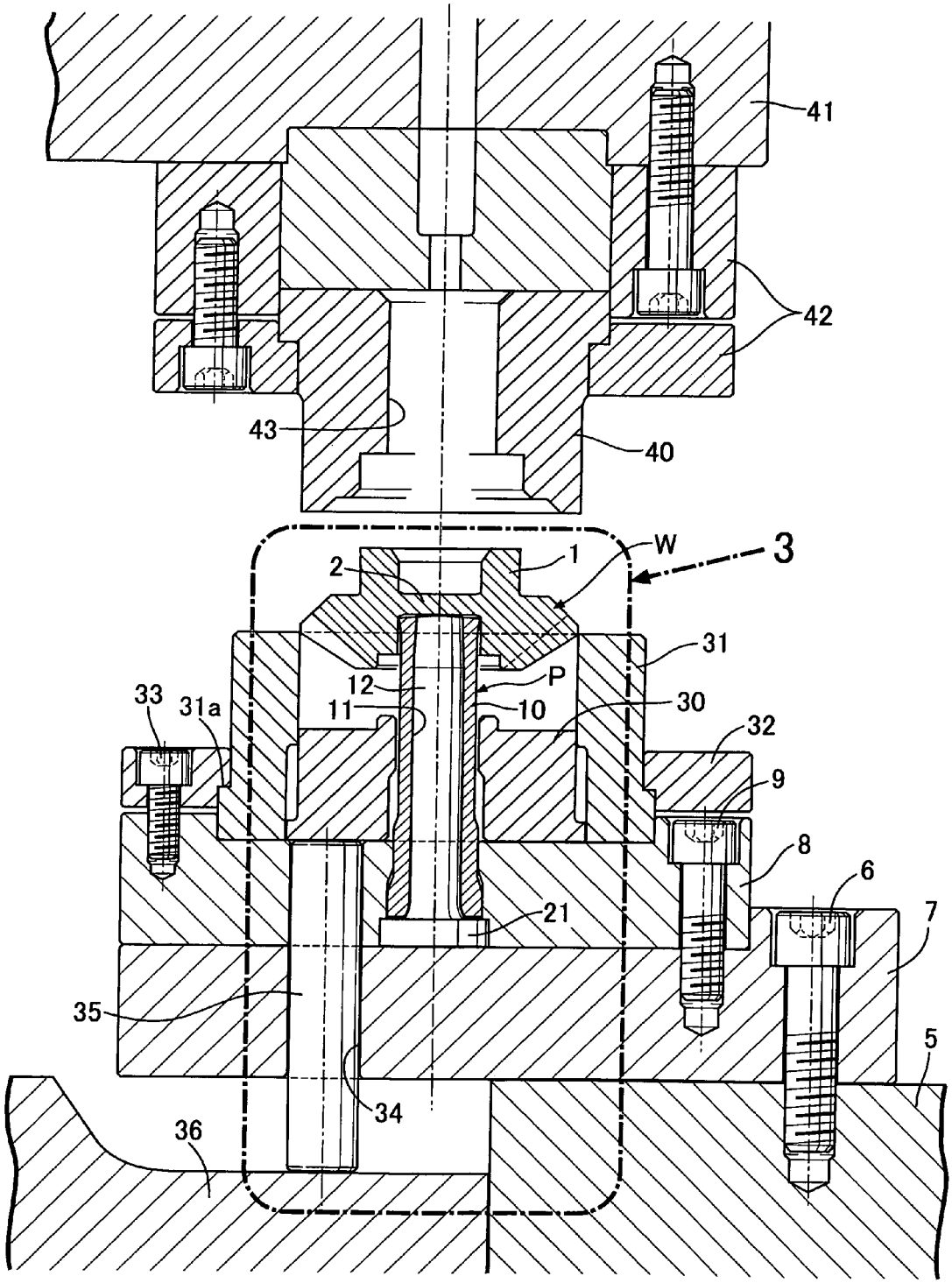

WORKPIECE PUNCHING STEP

WORKPIECE SEPARATING STEP

PUNCHING METHOD USING PUNCH AND PUNCH FOR PUNCHING

BACKGROUND OF THE INVENTION

1. Field of the Invention

The present invention relates to a punching method using a punch for forming a through-hole in a workpiece by punching the workpiece using a punch and a punch for punching, which is employed for carrying out the method.

2. Description of the Related Art

Such a punching method using a punch and a punch for punching are known from the Japanese Patent Application Laid-open 2006-305599.

Conventionally, a punch used for punching a workpiece is entirely solid, and thus has a high rigidity. This makes it possible to enhance the precision in dimensions of the hole formed by the punching. In this case, in order to improve the durability of a tooth portion of the punch, attention has been directed to improvements in the material of the punch and the thermal processing performed thereon. However, even such approaches have certain limitations.

SUMMARY OF THE INVENTION

The present invention has been made in view of the above-described circumstances, and an object of the present invention is to provide a punching method using a punch and a punch for punching, which make it possible to effectively improve the durability of a tooth portion of the punch.

In order to achieve the object, according to a first feature of the present invention, there is provided a punching method using a punch for forming a through-hole in a workpiece by punching the workpiece using a punch, the method comprising: making at least a tooth portion of the punch substantially solid when punching the workpiece by the punch; and when separating the workpiece from the punch after the punching of the workpiece, making the tooth portion substantially hollow, thereby to reduce a diameter of the tooth portion by a reaction force received from the workpiece.

With the first feature of the present invention, when the workpiece is punched using the punch, at least the tooth portion of the punch is made substantially solid. Accordingly, it is possible to secure the rigidity of the tooth portion, and thus to perform the punching with a high precision. On the other hand, when the punch is separated from the workpiece, the tooth portion is made substantially hollow, thereby a diameter of the tooth portion is reduced by the reaction force received from the workpiece. Accordingly, the friction force between the tooth portion and the workpiece can be reduced. As a result, it is possible not only to reduce the load required for separating the workpiece but also to effectively improve the durability of the tooth portion.

According to a second feature of the present invention, there is provided a punch for punching, which is employed for carrying out the punching method using a punch according to the first feature, comprising: a punch body including a tooth portion on an outer periphery of a tip end portion thereof, and a hollow portion in a center portion thereof; and a punch core slidably fitted into the hollow portion of the punch body, wherein the punch body and the punch core are configured so that, the punch core is tightly fitted to at least a part, corresponding to the tooth portion, of an inner peripheral surface of the hollow portion when a workpiece is punched by the tooth portion, and the punch core is separated from the inner peripheral surface when the workpiece is separated from the tooth portion after the punching.

With the second feature of the present invention, the punch has a simple structure including: a punch body including a tooth portion on an outer periphery of a tip end portion thereof, and a hollow portion in a center portion thereof; and a punch core slidably fitted into the hollow portion of the punch body. This simple structure also makes it possible to achieve the same effects as those of the first feature.

According to a third feature of the present invention, in addition to the second feature, the inner peripheral surface and an outer peripheral surface of the punch core which is capable of being tightly fitted to the inner peripheral surface are formed respectively into a female tapered surface and a male tapered surface each having a diameter decreasing in a direction in which the workpiece is separated from the tooth portion.

With the third feature of the present invention, in the punching of the workpiece by the tooth portion, the load applied from the workpiece to the tooth portion causes a wedging action between the female and male tapered surfaces tightly fitted to each other, and thus strengthens their tight fitting force. As a result, the solidity of the tooth portion, and further, the rigidity of the tooth portion can be effectively enhanced, so that the precision in the punching is further improved.

In addition, after the punching of the workpiece, when the punch body is moved with respect to the punch core, it is possible to also reduce the frictional resistance between the punch body and the punch core at an early stage, and also to separate the punch core from the inner peripheral surface of the tooth portion with a small amount of movement. Accordingly, this configuration contributes to an improvement in efficiency in the punching work.

An embodiment of the present invention is explained below by reference to a preferred embodiment of the present invention shown in the attached drawings.

BRIEF DESCRIPTION OF THE DRAWINGS

FIG. 1A illustrates a state of the workpiece before the punching, and FIG. 1B illustrates a state of the workpiece after the punching.

FIG. 2 is a vertical sectional view illustrating a punching apparatus for carrying out the method of the present invention.

DESCRIPTION OF THE PREFERRED EMBODIMENT

Figure 1A:
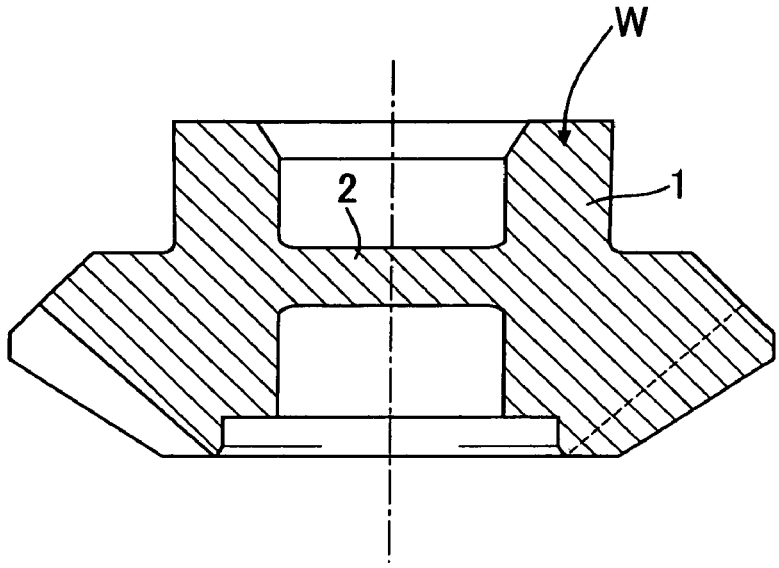
FIGS. 1A and 1B are vertical sectional views illustrating an example of a workpiece to be punched using a punch.
Figure 1B:
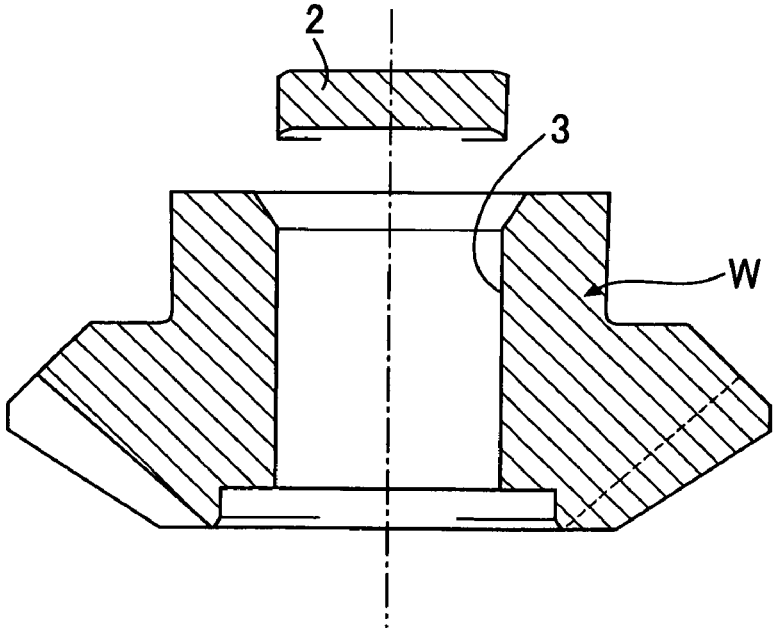

First, with reference to FIGS. 1A and 1B, an example of a workpiece to which the punching method of the present invention is employed will be described. A workpiece W illustrated in FIG. 1A is a semi-finished product of a bevel gear formed by a forging process, and a partition wall 2 remains in a middle of a hollow portion of a boss 1 of the workpiece W. As illustrated in FIG. 1B, the partition wall 2 is punched by the punching method of the present invention, so that a through-hole 3 is formed, thereby obtaining a finished product of the bevel gear.

A punching apparatus for carrying out the punching method of the present invention will be described with reference to FIGS. 2 to 4.

Figure 3:
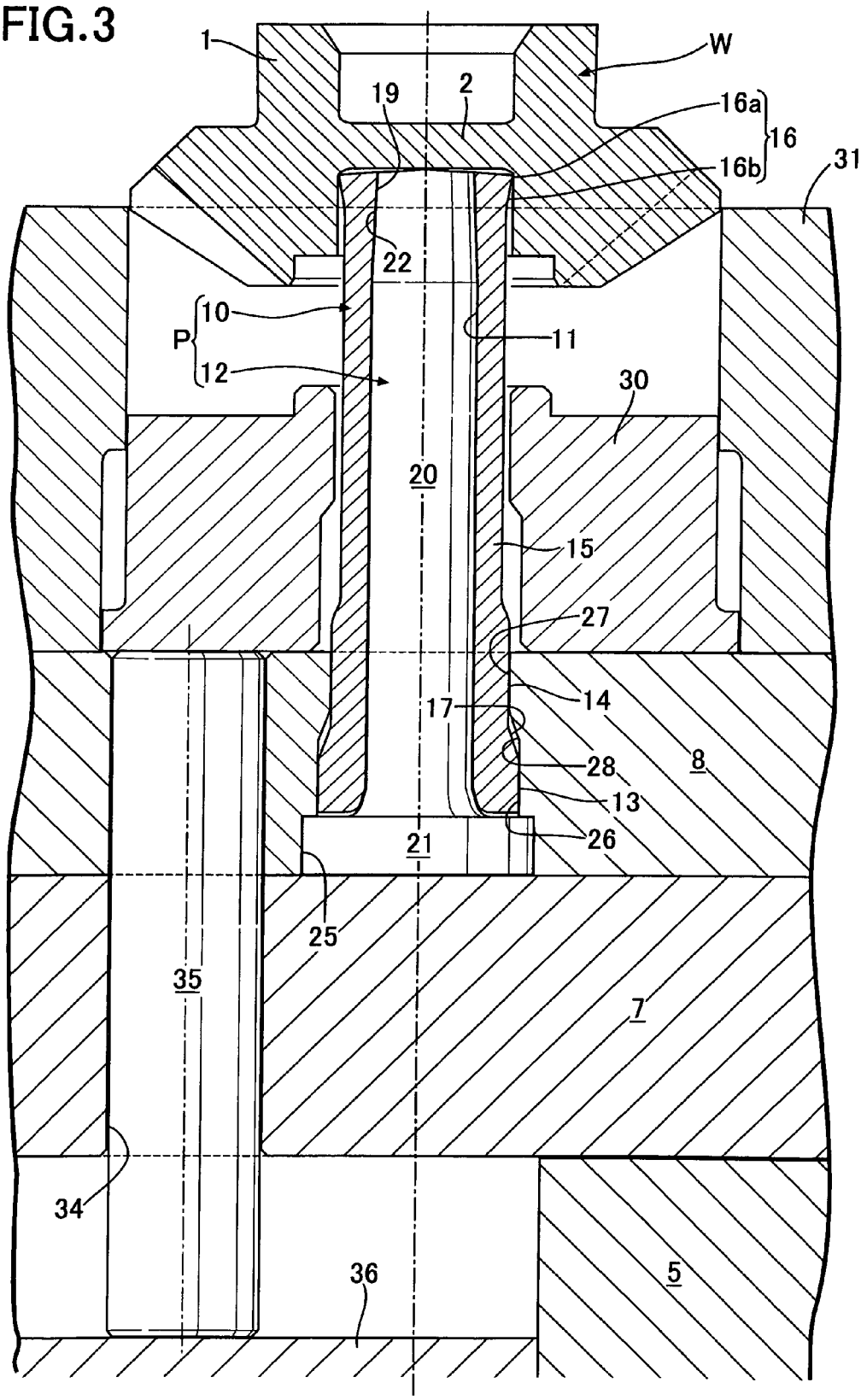
FIG. 3 is an enlarged view of a part indicated by the reference numeral 3 in FIG. 2.

In FIGS. 2 and 3, a punch holder base 7 is fixed to a press stage 5 with a bolt 6, and a punch holder 8 for holding a punch P is fixed to the punch holder base 7 with a bolt 9.

Figure 4:
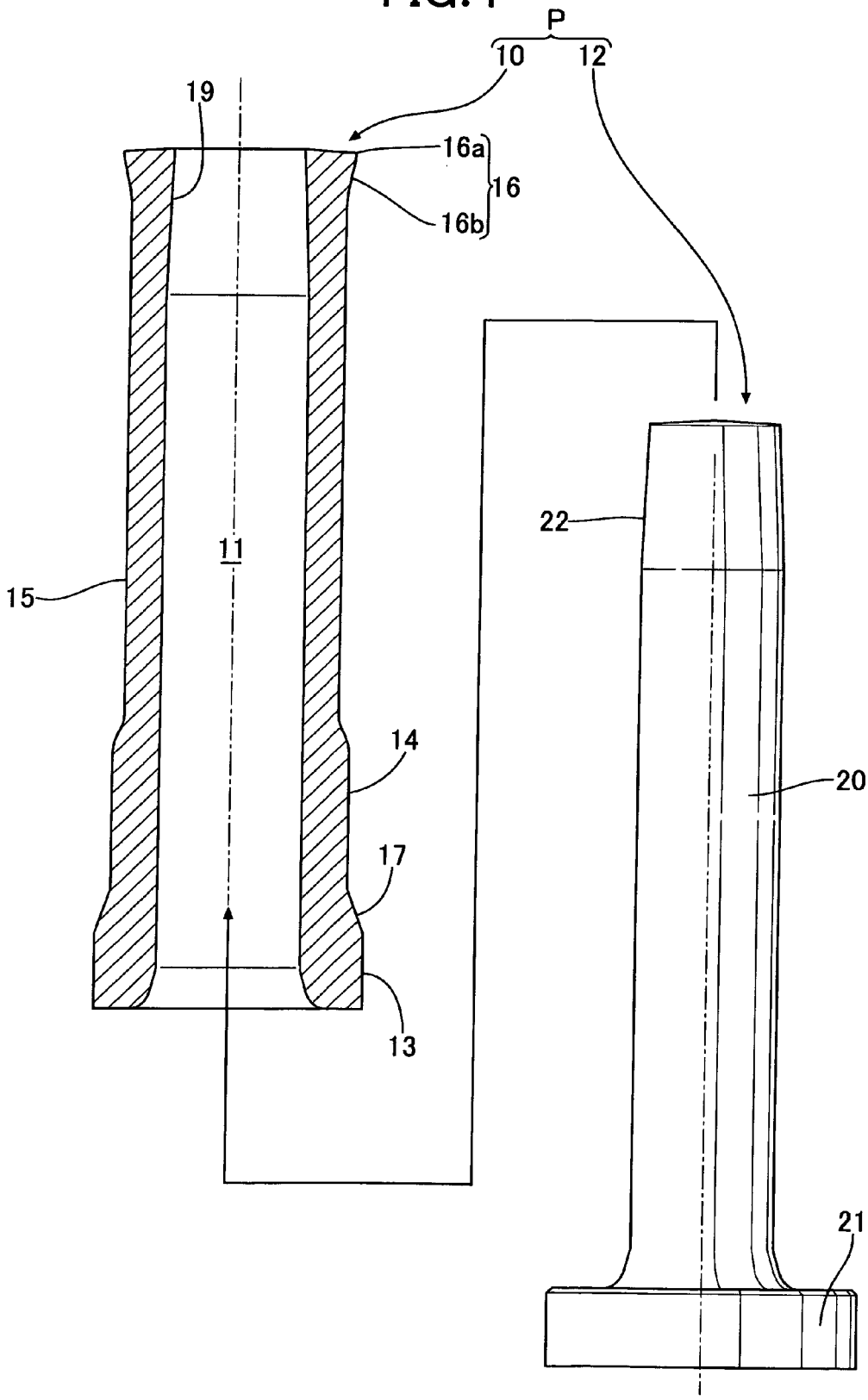
FIG. 4 is an exploded view illustrating the punch in the punching apparatus.

As illustrated in FIG. 4, the punch P includes a punch body 10 and a punch core 12 slidably fitted into a hollow portion 11 formed inside the punch body 10 over the entire length of the punch body 10 in an axial direction thereof. The punch body 10 basically has a cylindrical shape, and includes, from the lower end thereof: a first guide portion 13; a second guide portion 14 having a diameter smaller than that of the first guide portion 13; a shaft portion 15 having a diameter smaller than that of the second guide portion 14 and a length larger than the other portions; and a tooth portion 16 having an edge 16*a* which is formed on the outer periphery of the upper end thereof and which has a diameter larger than that of the shaft portion 15. A tapered first stopper surface 17 is formed between the first and second guide portions 13 and 14. A tapered undercut 16*b* having a diameter gradually decreasing from the edge 16*a* to the shaft portion 15 is formed on the outer periphery of the tooth portion 16. The tooth portion 16 can be fitted into the boss 1 so as to punch the partition wall 2 of the workpiece W.

A female tapered surface 19 is formed on the inner peripheral surface of the hollow portion 11 at least at a part corresponding to the tooth portion 16. The female tapered surface 19 has a diameter decreasing toward the upper end of the hollow portion 11. This female tapered surface 19 functions as a stop member to limit slidable movement of the punch core in the punch body, such that a tip end of the punch core is prevented from extending outwardly beyond the tooth portion 16 of the punch body.

On the other hand, the punch core 12 includes: a shaft portion 20 having an outer peripheral surface matching the inner peripheral surface of the hollow portion 11; and a flange 21 continuously provided at the lower end of the shaft portion 20. The flange 21 has a diameter larger than that of the first guide portion 13.

The outer peripheral surface of the upper end portion of the shaft portion 20 is formed into a male tapered surface 22 capable of tightly fitting into the female tapered surface 19 of the punch body 10. When the male tapered surface 22 is tightly fitted into the female tapered surface 19, the punch body 10 is located at its lowest position where the punch body 10 comes closest to the flange 21.

In FIGS. 2 and 3 again, the punch holder 8 has a holding hole 25 as well as first and second guide holes 26 and 27 formed therein. The holding hole 25 is fitted onto and thus holds the flange 21 of the punch core 12, while the first and second guide portions 13 and 14 of the punch body 10 are slidably fitted respectively into the first and second guide holes 26 and 27. Between the first and second guide holes 26 and 27, a tapered second stopper surface 28 is formed to prevent the punch body 10 from further moving up by coming into contact with the first stopper surface 17, when the punch body 10 is moved up by a predetermined distance from its lowest position relative to the punch core 12.

A workpiece receiving table 30, surrounding the punch P, is disposed on the upper surface of the punch holder 8, and a workpiece receiving table guide 31 is fixed to the punch holder 8. The workpiece receiving table 30 is installed to be capable of moving up and down, and the workpiece receiving table guide 31 is slidably fitted onto the outer periphery of the workpiece receiving table 30, and is configured to guide the up and down movement of the workpiece receiving table 30. The workpiece receiving table guide 31 is fixed by using a hold down ring 32 engaged with an annular step portion 31*a* formed on the outer periphery of the workpiece receiving table guide 31, and a bolt 33 fixing the hold down ring 32 to the punch holder 8. The workpiece receiving table guide 31 is capable of receiving and accommodating the workpiece W moving down at the time of punching the partition wall 2 of the workpiece W.

A plurality of guide holes 34 are formed in the punch holder 8 and the punch holder base 7. Each of the guide holes 34 vertically penetrates the punch holder 8 and the punch holder base 7 at a position immediately below the workpiece receiving table 30. A plurality of extruding pins 35 (only one of them is shown in FIG. 2), which are capable of coming into contact with the lower surface of the workpiece receiving table 30, are slidably inserted and fitted respectively into the guide holes 34. The extruding pins 35 are supported by an extruding block 36 which is driven to move up by a driving source such as a hydraulic cylinder.

A die 40 cooperating with the punch P is disposed coaxially above the workpiece receiving table 30. The die 40 is held by a die holder 42 fixed to a ram 41 which is driven to move up and down by a driving source such as a motor or a hydraulic cylinder. The die 40 is provided with a relief hole 43 which receives a scrap 2 generated by the punching using the punch P.

When the partition wall 2 of the workpiece W is punched, first as shown in FIG. 2, the boss 1 is fitted onto the outer periphery of the upper end portion of the punch P while the workpiece W is set to face in a predetermined direction, so that the partition wall 2 is supported on the end surface of the tooth portion 16. At this time, the extruding pins 35 are located at its down positions, so that the workpiece receiving table 30 is on the upper surface of the punch holder 8. The punch body 10 is located at its lowest position so as to come closest to the flange 21 of the punch core 12, so that the female tapered surface 19 of the punch body 10 is tightly fitted onto the male tapered surface 22 of the punch core 12. Accordingly, the punch P is substantially solid over its entire length in this state.

Figure 5:
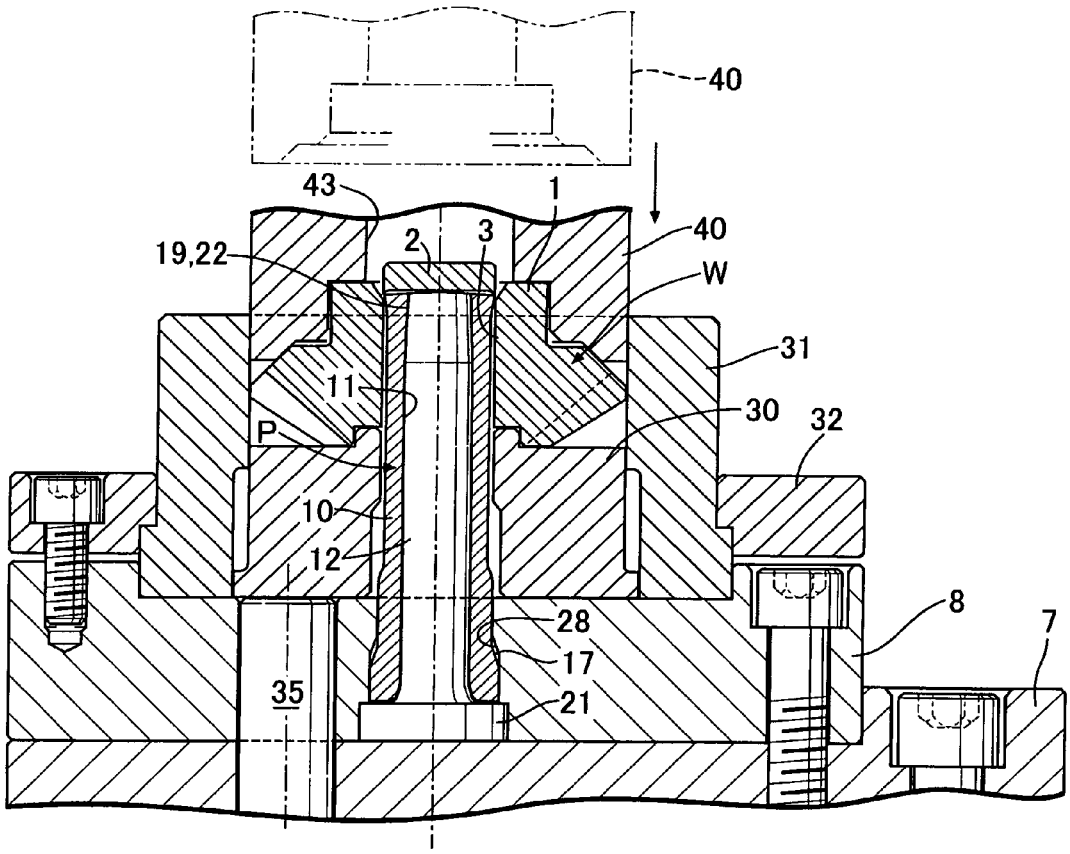
FIG. 5 is a view corresponding to FIG. 2 and illustrating a state of the workpiece immediately after being punched using the punch.

Subsequently, as shown in FIG. 5, the die 40 is moved down by the ram 41 so as to press the workpiece W until the workpiece W comes into contact with the workpiece receiving table 30. During this time, the partition wall 2 of the workpiece W is punched upward by the tooth portion 16 of the punch body 10, so that the through-hole 3 is formed in the boss 1. The partition wall 2 thus removed by the punching, i.e. the scrap 2 is pushed up to the relief hole 43 of the die 40 by the punch P.

In this punching, the tooth portion 16 receives the load from the workpiece W in a direction to reduce its diameter as a reaction force, and then, the load is tightly received by the punch core 12 from the tooth portion 16 through the female and male tapered surfaces 19 and 22 tightly fitted to each other. Accordingly, the rigidity of the tooth portion 16 is secured, so that the punching with a high precision can be performed.

Figure 6:
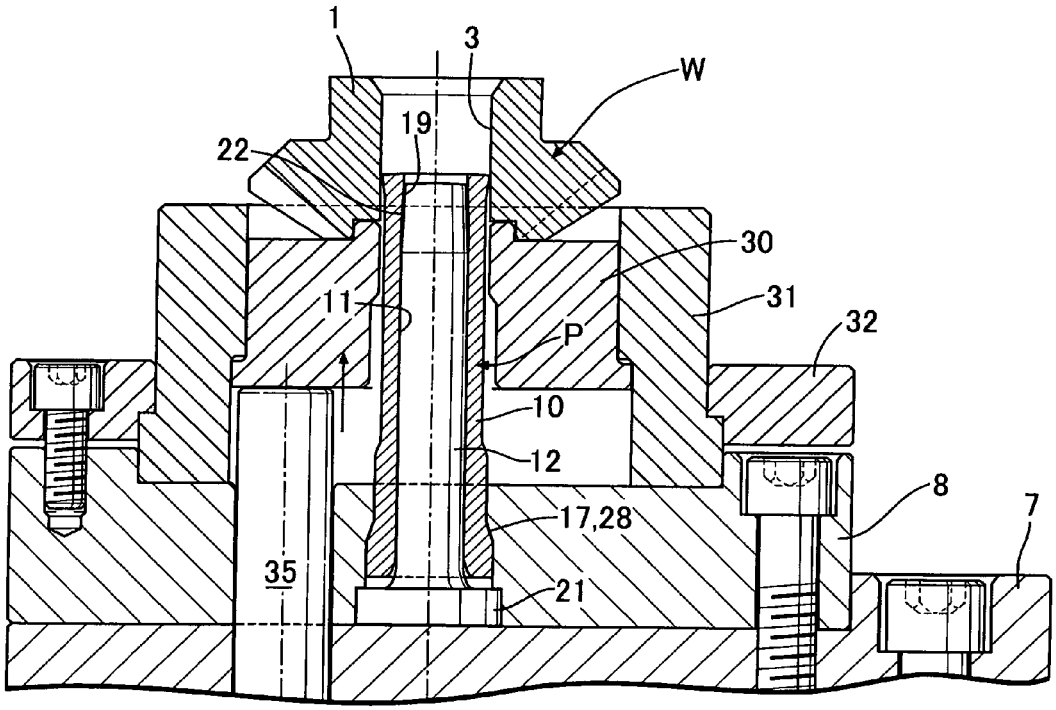
FIG. 6 is a view corresponding to FIG. 5 and illustrating how the workpiece is extruded after the punching.

After the punching of the partition wall 2, the ram 41 is moved up, so that the die 40 is moved up and away from the workpiece W. Then, as shown in FIG. 6, the extruding block 36 is moved up to cause the extruding pins 35 to press up the workpiece receiving table 30 having the workpiece W placed thereon.

At this time, since a large friction force exists between the workpiece W and the tooth portion 16 of the punch body 10, the workpiece W thus moving up pulls up, with the friction force, the punch body 10 slidably fitted on the fixed punch core 12. As a result, the punch core 12 leaves from the inner peripheral surface of the tooth portion 16 of the punch body 10, so that the tooth portion 16 becomes substantially hollow.

Accordingly, the tooth portion 16 unavoidably reduces its diameter by the reaction force received from the workpiece W. Consequently, the friction force between the tooth portion 16 and the workpiece W is decreased.

Once the punch body 10 is moved up with respect to the punch core 12 until the friction force between the tooth portion 16 and the workpiece W is decreased, the second stopper surface 28 of the punch body 10 comes into contact with the first stopper surface 17 of the punch core 12 so as to prevent the punch body 10 from further moving up. Accordingly, the moving up of the workpiece receiving table 30 by the extruding pins 35 thereafter pushes up only the workpiece W. At this stage, since the friction force between the tooth portion 16 and the workpiece W has already been decreased as described above, the workpiece W can be smoothly separated from the tooth portion 16. For this reason, it is possible not only to reduce the load required for separating the workpiece W but also to significantly improve the durability of the tooth portion 16.

Once the workpiece receiving table 30 reaches its upper end position, the workpiece W is pushed up to be located above the workpiece receiving table guide 31 so as to be removable therefrom.

Meanwhile, the female and male tapered surfaces 19 and 22, which are tightly fitted to each other on the inner peripheral side of the tooth portion 16, are formed respectively in the punch body 10 and the punch core 12. Accordingly, in the punching of the workpiece W by the tooth portion 16, the load applied from the workpiece W to the tooth portion 16 causes a wedging action between the female and male tapered surfaces 19 and 22 tightly fitted to each other, and thus strengthens their tight fitting force. As a result, the solidity on the inner peripheral side of the tooth portion 16, and further, the rigidity of the tooth portion 16 can be enhanced, so that the precision in the punching is further improved.

In addition, after the punching of the workpiece W, when the punch body 10 is moved up with respect to the punch core 12, it is possible to reduce the frictional resistance between the punch body 10 and the punch core 12 at an early stage, and also to separate the punch core 12 from the inner peripheral surface of the tooth portion 16 with a small amount of movement. Accordingly, this configuration contributes to an improvement in efficiency in the punching work.

The present invention is not limited to the above-described embodiment, and various modifications in design may be made thereon without departing from the scope of the present invention. For example, if the inner peripheral side of the tooth portion 16 is simply made hollow after the punching of the workpiece W, it is possible to replace each of the female and male tapered surfaces 19 and 22, which are tightly fitted to each other, with simple cylindrical surfaces. This case, however, does not entail the occurrence of the wedging action unlike the above-described embodiment, and also increases the amount of the upward movement of the punch body 10 for making the inner peripheral side of the tooth portion 16 hollow after the punching of the workpiece W.

What is claimed is:

1. A punching method using a punch for forming a through-hole in a workpiece by punching the workpiece using a punch, the method comprising the steps of:

making at least a tooth portion of the punch substantially solid, wherein the punch comprises a cylindrical punch body having a hollow bore formed therein, the punch body comprising a tip end portion having a female tapered surface formed in the hollow bore thereof, and a solid punch core which fits nestingly into the hollow bore of the punch body, the punch core comprising a tip end portion having a male tapered surface, wherein the tooth portion comprises the tip end portion of the punch body, and wherein the tooth portion is made into a substantially solid state by aligning the tip end portion of the punch core with the tip end portion of the punch body;

punching all of the way through a partition wall in at least one portion of the workpiece with the tooth portion of the punch in said substantially solid state, whereby the punch breaks said partition wall out of the workpiece to form a punched-out portion and create said through-hole in the workpiece;

separating the tip end portion of the punch core and the tip end portion of the punch body while the tip end portion of the punch body is extended through the punched-out portion of the workpiece, whereby the tooth portion is made substantially hollow; and separating the workpiece from the punch body after the punching of the workpiece while keeping the tooth portion substantially hollow, thereby to reduce a diameter of the tooth portion by a reaction force received from the workpiece.

2. The punching method of claim 1, wherein the punching step comprises moving at least one of the punch and the workpiece relative to the other.

3. A punch for punching, which is configured for carrying out the punching method using a punch according to claim 1, said punch comprising:

a punch body including a tooth portion on an outer periphery of a tip end portion thereof, said punch body having a hollow portion formed in a center portion thereof and having a stop member formed therein, the hollow portion of the punch body comprising a female tapered surface at said tip end portion;

and a punch core which is slidably fitted into the hollow portion of the punch body, the punch core comprising a tip end portion having a male tapered surface thereon which fits nestingly in the female tapered surface of the punch body;

wherein the punch body and the punch core are configured so that, the punch core comprises limiting structure for cooperating with the stop member of the punch body to limit slidable movement of the punch core in the punch body, such that the tip end portion of the punch core is prevented from substantially extending outwardly beyond the tooth portion of the punch body, and the punch core is configured to be tightly fitted to at least a part, corresponding to the tooth portion of an inner peripheral surface of the hollow portion of the punch body when a workpiece is punched by the tooth portion, and the punch core is separable from the inner peripheral surface of the hollow portion of the punch body when the workpiece is separated from the tooth portion after the punching.

4. The punch for punching according to claim 3, wherein the inner peripheral surface of the hollow portion and an outer peripheral surface of the punch core which is configured to be tightly fitted to the inner peripheral surface are formed respectively into said female tapered surface and said male tapered surface, each having a diameter decreasing in a direction in which the workpiece is separated from the tooth portion.

* * * * *